US009370458B2

(12) United States Patent
Wem

(10) Patent No.: US 9,370,458 B2
(45) Date of Patent: Jun. 21, 2016

(54) PERSONAL LIFTING ASSEMBLY

(71) Applicant: Donald Wem, Chagrin Falls, OH (US)

(72) Inventor: Donald Wem, Chagrin Falls, OH (US)

( * ) Notice: Subject to any disclaimer, the term of this patent is extended or adjusted under 35 U.S.C. 154(b) by 99 days.

(21) Appl. No.: 14/534,925

(22) Filed: Nov. 6, 2014

(65) Prior Publication Data

US 2016/0128884 A1 May 12, 2016

(51) Int. Cl.
*A61G 7/012* (2006.01)
*A61G 7/10* (2006.01)

(52) U.S. Cl.
CPC ..... *A61G 7/1019* (2013.01)

(58) Field of Classification Search
CPC ..... A61G 7/012
USPC ..... 5/83.1, 86.1
See application file for complete search history.

(56) References Cited

U.S. PATENT DOCUMENTS 2,579,577 A 12/1961 Hill
3,988,790 A * 11/1976 Mracek ..... A61G 7/08 5/83.1
4,232,901 A 11/1980 Harrington et al.
5,007,121 A 4/1991 McEathron
6,109,395 A 8/2000 Storm
6,113,188 A 9/2000 Stewart et al.
6,286,812 B1 9/2001 Cherry
D452,056 S 12/2001 Rosania
6,384,404 B1 5/2002 Berg
9,254,232 B2 * 2/2016 Hjort ..... A61G 7/1007
2004/0068797 A1 * 4/2004 Smith ..... A61G 13/06 5/617

FOREIGN PATENT DOCUMENTS

WO WO02078590 10/2002

* cited by examiner

*Primary Examiner* — Fredrick Conley

(57) ABSTRACT

A personal lifting includes a housing that may be positioned on a support surface. The housing is divided into an upper half and a lower half of the housing. A motor is coupled to the lower half of the housing. A pump is coupled to the lower half of the housing and the motor. A scissor lift is coupled between the top and bottom halves of the housing. A piston is coupled between the bottom half of the housing and the scissor lift. The piston urges the scissor lift in a lifting position. The scissor lift may lift a user lying on the upper half of the housing. The piston urges the scissor lift in a lowering position. A handle is coupled to the top half of the housing. An actuator is coupled to the handle and the motor. The actuator actuates and de-actuates the motor.

13 Claims, 8 Drawing Sheets

PERSONAL LIFTING ASSEMBLY

BACKGROUND OF THE DISCLOSURE

Field of the Disclosure

The disclosure relates to lifting devices and more particularly pertains to a new lifting device for lifting a user upwardly from a support surface after the user falls such that user does not need assistance.

SUMMARY OF THE DISCLOSURE

An embodiment of the disclosure meets the needs presented above by generally comprising a housing that may be positioned on a support surface. The housing is divided into an upper half and a lower half of the housing. A motor is coupled to the lower half of the housing. A pump is coupled to the lower half of the housing. The pump is coupled to the motor. A scissor lift is coupled between the top and bottom halves of the housing. A piston is coupled between the bottom half of the housing and the scissor lift. The piston is operationally coupled to the pump. The piston urges the scissor lift in a lifting position. The top half of the housing is spaced upwardly from the bottom half of the housing. The scissor lift may lift a user lying on the upper half of the housing. The piston urges the scissor lift in a lowering position. The top half of the housing abuts the bottom half of the housing. A handle is coupled to the top half of the housing. The handle may be gripped by the user. An actuator is coupled to the handle. The actuator is operationally coupled to the motor. The actuator actuates and de-actuates the motor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
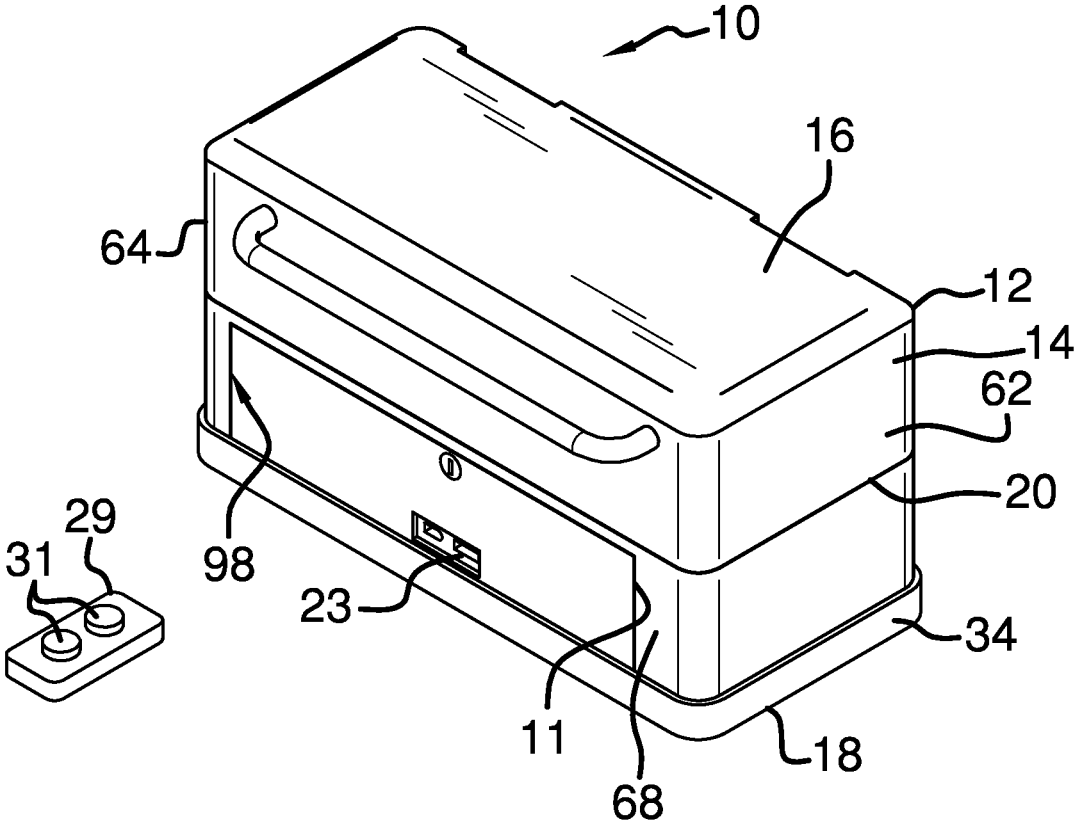
FIG. 1 is a perspective view of a personal lifting assembly according to an embodiment of the disclosure.
Figure 2:
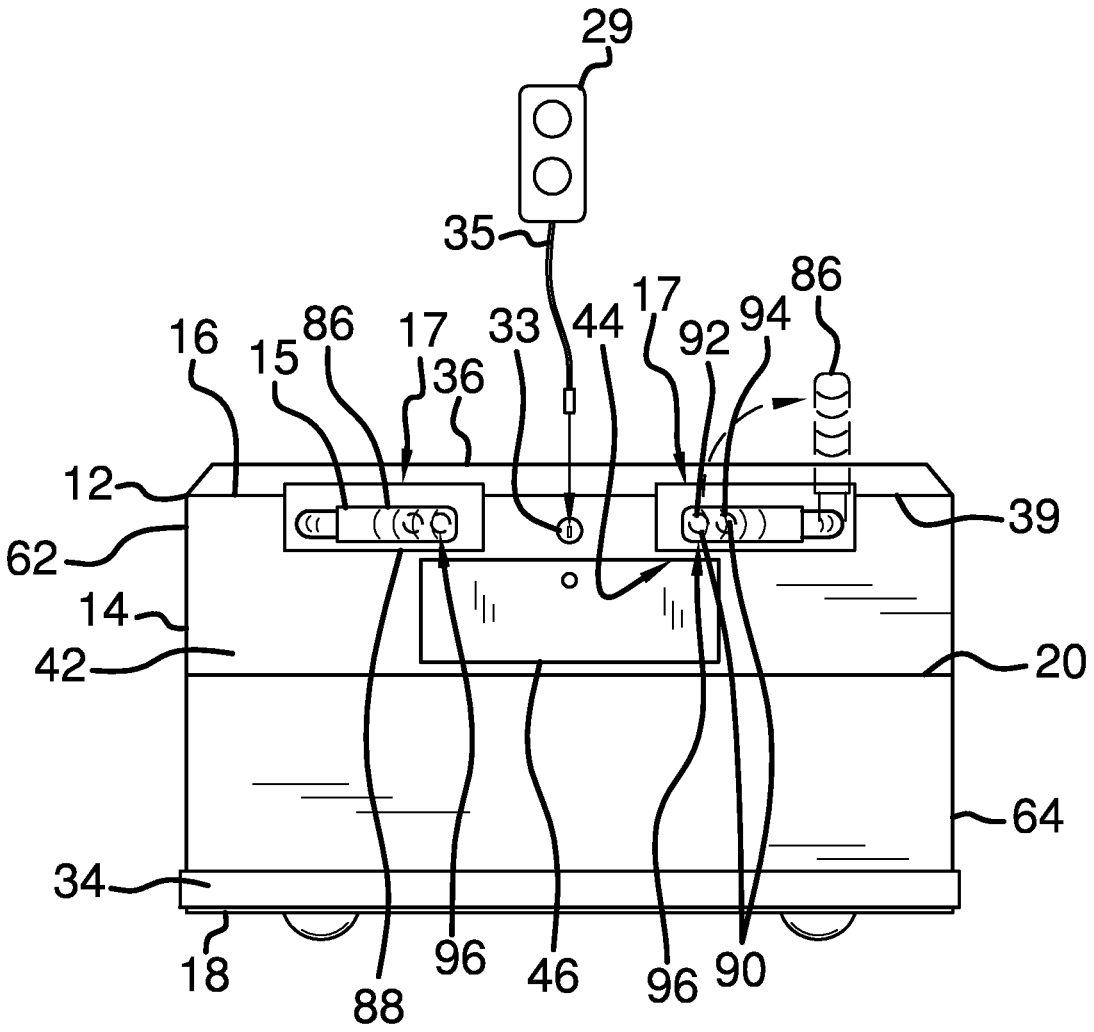
FIG. 2 is a front view of an embodiment of the disclosure.
Figure 3:
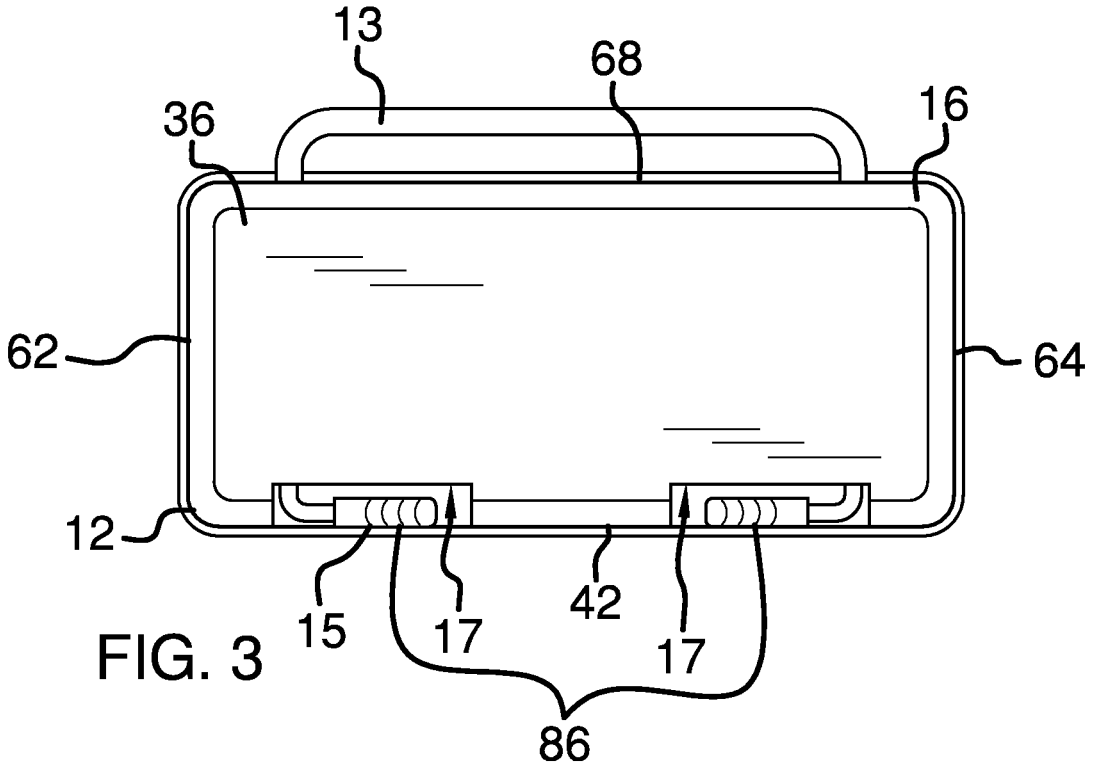
FIG. 3 is a top view of an embodiment of the disclosure.
Figure 4:
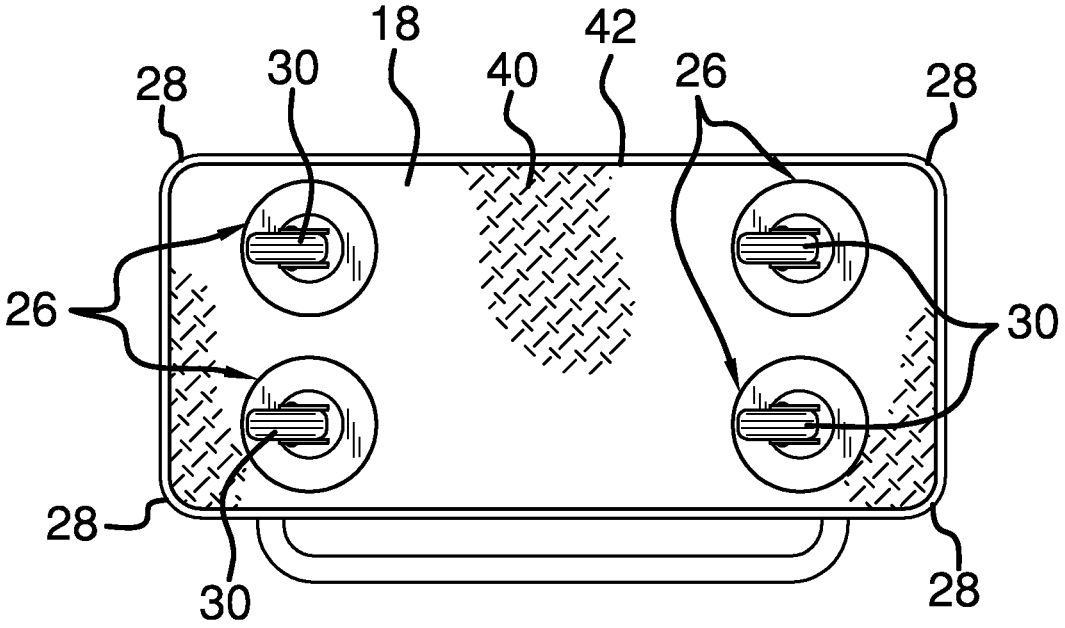
FIG. 4 is a bottom view of an embodiment of the disclosure.
Figure 5:
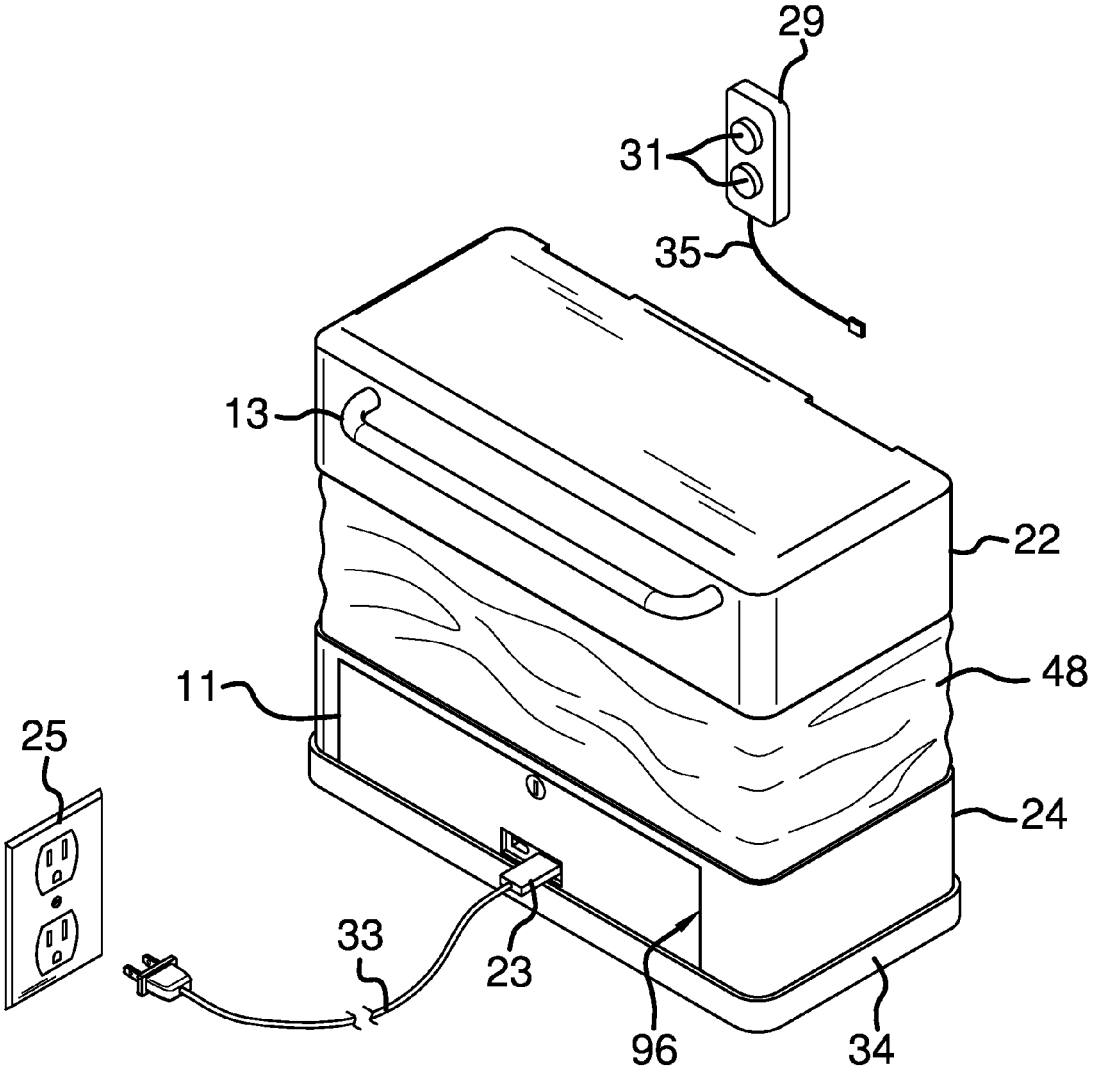
FIG. 5 is a back perspective view of an embodiment of the disclosure.
Figure 6:
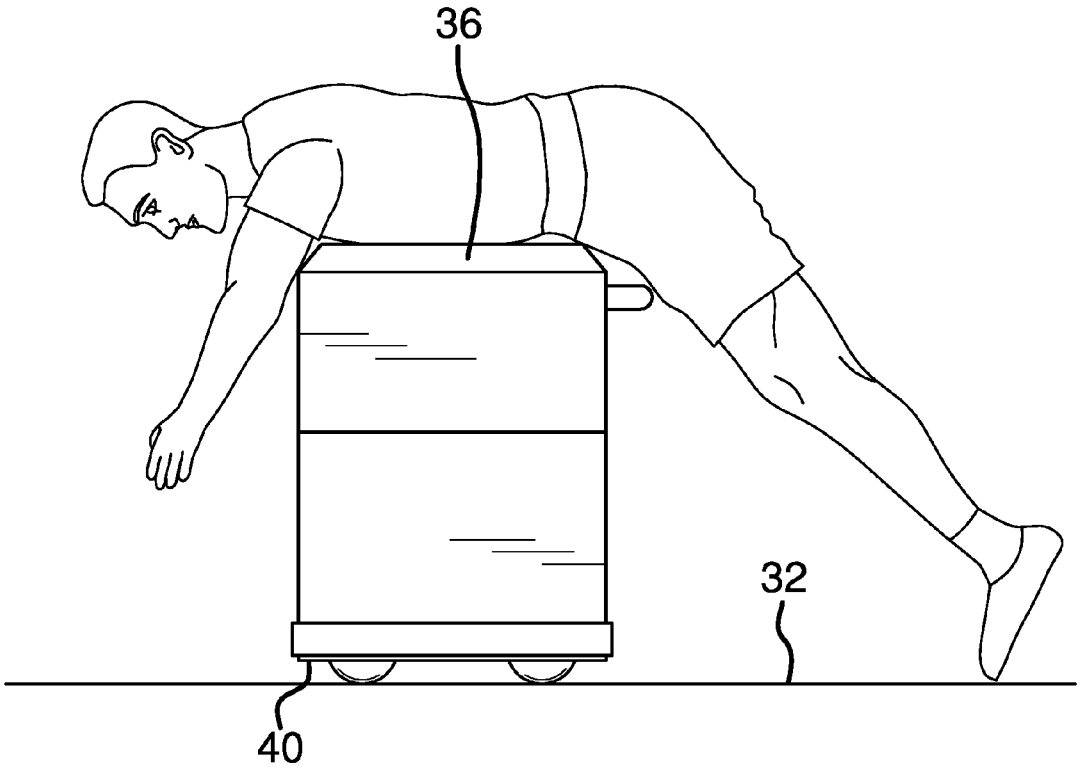
FIG. 6 is an in-use view of an embodiment of the disclosure.
Figure 7:
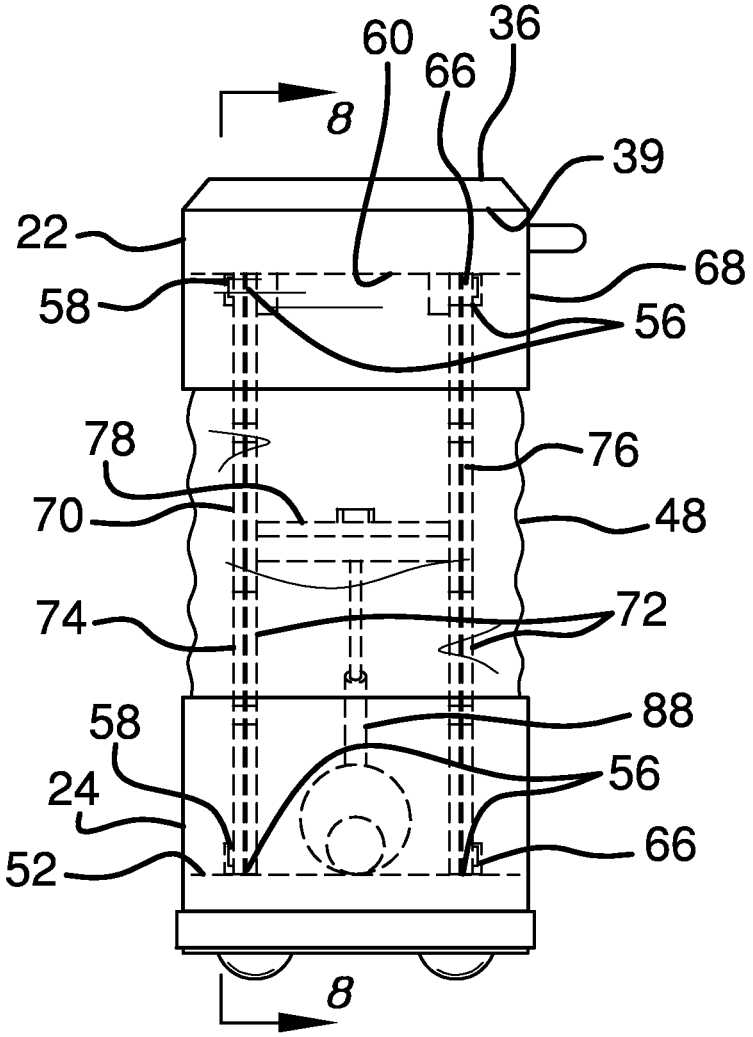
FIG. 7 is a left side view of an embodiment of the disclosure.
Figure 8:
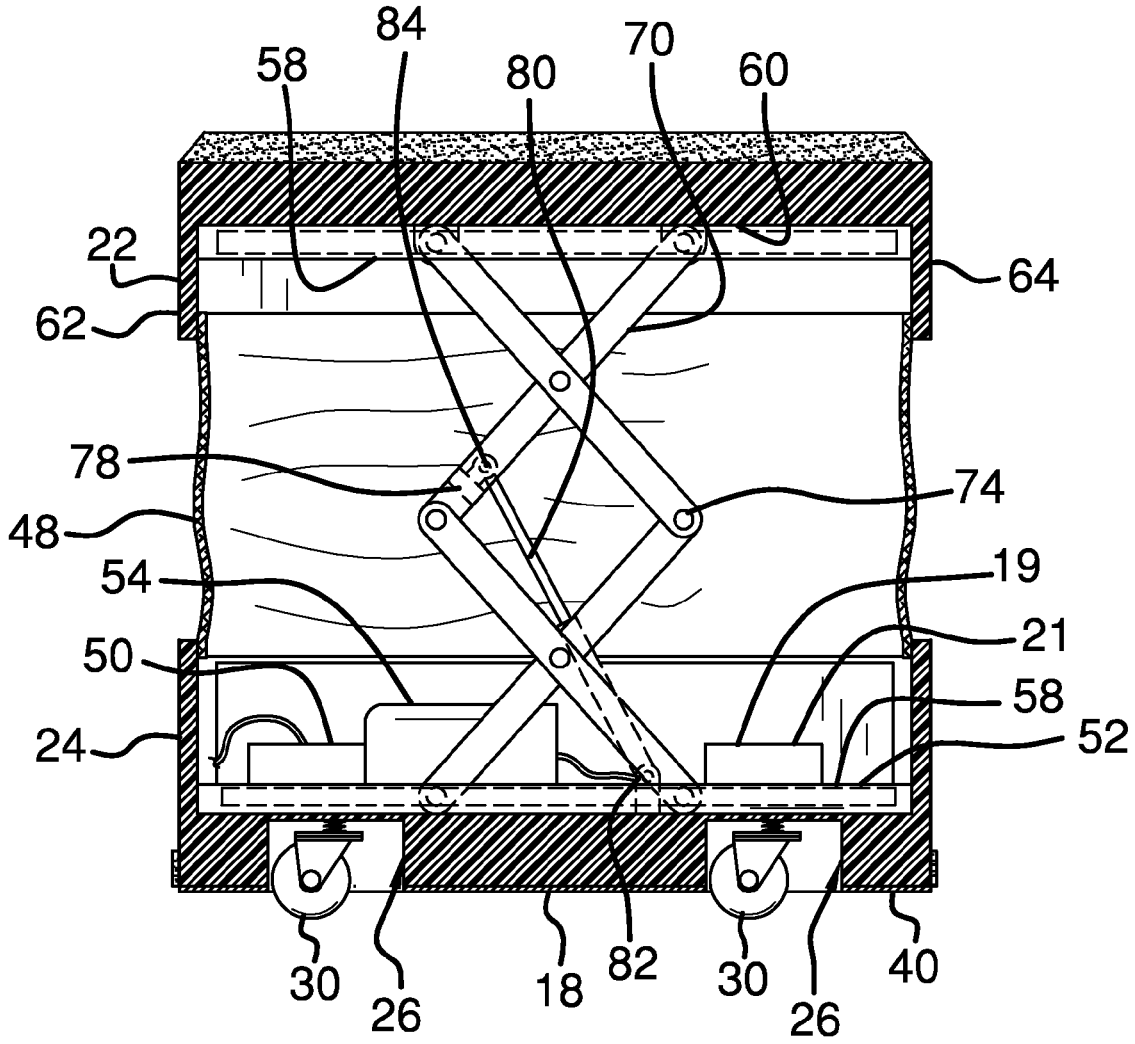
FIG. 8 is a cross sectional view taken along line 8-8 of FIG. 7 of an embodiment of the disclosure.
Figure 9:
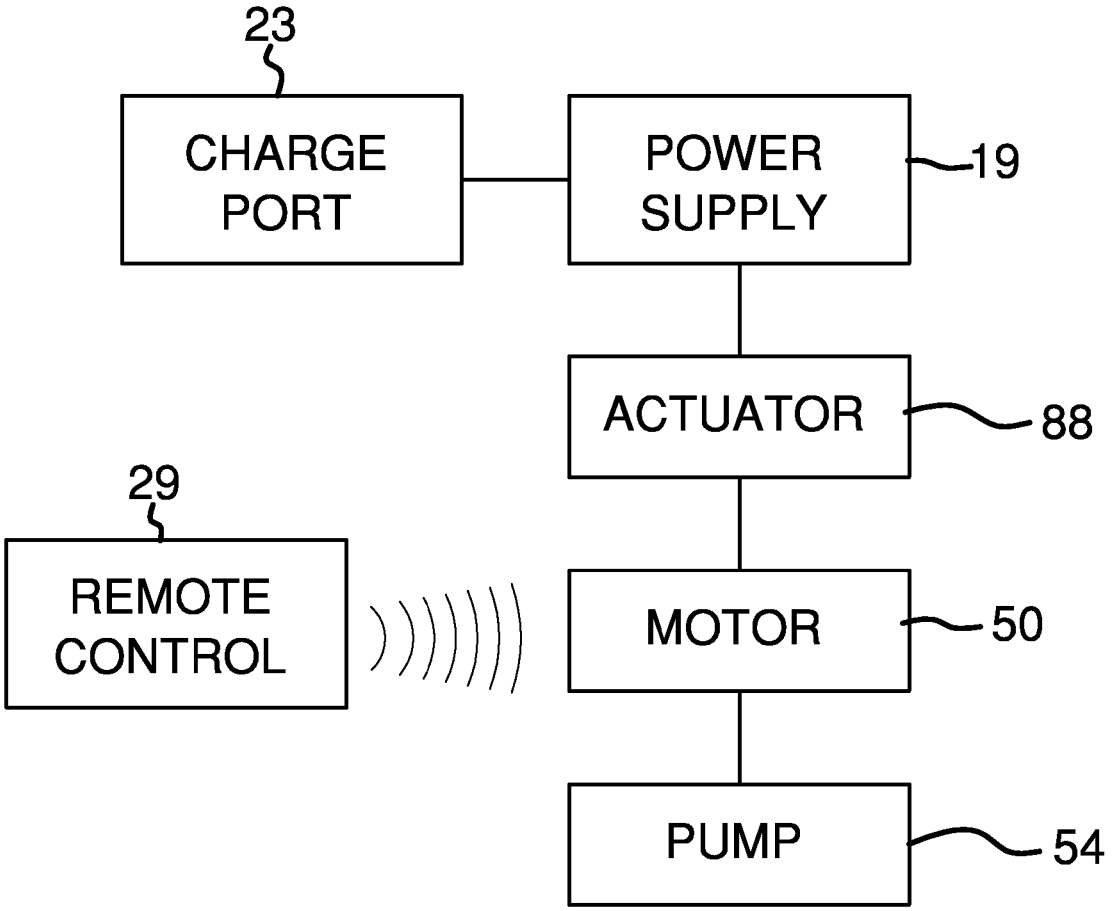
FIG. 9 is a schematic view of an embodiment of the disclosure.

With reference now to the drawings, and in particular to FIGS. 1 through 9 thereof, a new lifting device embodying the principles and concepts of an embodiment of the disclosure and generally designated by the reference numeral 10 will be described.

As best illustrated in FIGS. 1 through 9, the personal lifting assembly 10 generally comprises a housing 12. The housing 12 has an outer wall 14 extending between a top wall 16 and a bottom wall 18 of the housing 12. The outer wall 14 of the housing 12 has a cut 20 extending around an entire perimeter of the outer wall 14 of the housing 12. The cut 20 defines an upper half 22 and a lower half 24 of the housing 12.

The bottom wall 18 of the lower half 24 of the housing 12 has a plurality of wheel wells 26 extending upwardly therein. Each of the plurality of wheel wells 26 is positioned proximate an associated one of four corners 28 of the lower half 24 of the housing 12. A plurality of wheels 30 is coupled to the bottom wall 18 of the lower half 24 of the housing 12. Each of the plurality of wheels 30 is positioned within an associated one of the plurality of wheel wells 26. The plurality of wheels 30 is each configured to abut a support surface 32 so the housing 12 is supported above the support surface 32. A front set 27 of the plurality of wheels 30 may be swiveled to steer the housing 12. Each of the wheels 30 may be selectively locked to retain the housing 12 in a stationary position.

A lower pad 34 is coupled to the outer wall 14 of the lower half 24 of the housing 12. The lower pad 34 is positioned proximate the bottom wall 18 of the lower half 24 of the housing 12. Additionally, the lower pad 34 extends around the entire perimeter of the outer wall 14 of the lower half 24 of the housing 12.

A pad 36 is provided. A lowermost side 39 of the pad 36 is coupled to the top wall 16 of the upper half 22 of the housing 12. The pad 36 completely covers the top wall 16 of the upper half 22 of the housing 12. A user 38 lies on the pad 36. The user 38 may be an elderly person or other similar user that is susceptible to falling down.

A gripping layer 40 is coupled to the bottom wall 18 of the lower half 24 of the housing 12. The gripping layer 40 completely covers the bottom wall 18 of the lower half 24 of the housing 12. Each of the plurality of wheels 30 are each compressible upwardly into the associated one of the plurality of wheel wells 26. The gripping layer 40 engages the support surface 32 when the user 38 lies on the pad 36. The gripping layer 40 prevents the housing 12 from moving on the support surface 32 while the user 38 lies on the pad 36.

A front side 42 of the outer wall 14 of the upper half 22 of the housing 12 has a storage well 44 extending rearwardly therein. A storage door 46 is hingedly coupled to the front side 42 of the outer wall 14 of the upper half 22 of the housing 12. The storage door 48 closes the storage well 44.

A curtain 48 is coupled between each of the upper 22 and lower 24 halves of the housing 12. The curtain 48 is coextensive with the cut 20. The curtain 48 conceals an interior of the housing 12. A motor 50 is coupled to an upper surface 52 of the bottom wall 18 of the lower half 24 of the housing 12. The motor 50 may be an electric motor of any conventional design.

A pump 54 is coupled to the upper surface 52 of the bottom wall 18 of the lower half 24 of the housing 12. The pump 54 is coupled to the motor 50. The motor 50 drives the pump 54. Additionally, the pump 54 may be a hydraulic pump of any conventional design.

A plurality of roller tracks 56 is provided. A first pair 58 of the plurality of roller tracks 56 is each coupled to an associated one of the upper surface 52 of the bottom wall 18 of the lower half 24 of the housing 12 and a lower surface 60 of the top wall 16 of the upper half 22 of the housing 12. The first pair of roller tracks 58 extends between a first lateral side 62 and a second lateral side 64 of the outer wall 14 of the housing 12. A second pair 66 of the plurality of roller tracks 56 is coupled to an associated one of the upper surface 52 of the bottom wall 18 of the lower half 24 of the housing 12 and the lower surface 60 of the top wall 16 of the upper half 22 of the housing 12. The second pair of roller tracks 66 extends between the first 62 and second 64 lateral sides of the outer wall 14 of the housing 12. Each of the first 58 and second 66 pairs of roller tracks is positioned proximate an associated one of the front side 42 and a back side 68 of the outer wall 14 of the housing 12.

A scissor lift 70 is provided. The scissor lift 70 is one of a pair of the scissor lifts 72. A first one 74 of the pair of scissor lifts 72 is slidably coupled between each of the first pair of roller tracks 58. A second one 76 of the pair of scissor lifts 72 is slidably coupled between each of the second pair of roller tracks 66. Each of the pair of scissor lifts 72 may be a scissor lift of any conventional design.

A piston bar 78 is coupled to and extends between each of the pair of scissor lifts 72. The piston bar 78 is centrally positioned on each of the pair of scissor lifts 72. A piston 80 is provided. A bottom end 82 of the piston 80 is coupled to the upper surface 52 of the bottom wall 18 of the lower half 24 of the housing 12. A top end 84 of the piston 80 is coupled to the piston bar 78. The piston 80 is fluidly coupled to the pump 54. Moreover, the piston 80 may be a hydraulic piston of any conventional design.

The piston 80 urges the pair of scissor lifts 72 into a lifting position. The upper half 22 of the housing 12 is spaced upwardly from the lower half 24 of the housing 12 in the lifting position. The pair of scissor lifts 72 raises the user 38 lying on the pad 36. The piston 80 urges the pair of scissor lifts 72 in a lowering position. The upper half 22 of the housing 12 abuts the lower half 24 of the housing 12 in the lowering position.

The front side 42 of the outer wall 14 of the upper half 22 of the housing 12 has a pair of handle wells 17 extending rearwardly therein. Each of the pair of handle wells 17 is positioned proximate an associated one of the first 62 and second 64 lateral sides of the outer wall 14 of the upper half 24 of the housing 12. A handle 15 is provided. The handle 15 is bent so that the handle 15 has an L-shape.

The handle 15 is rotatably coupled to the front side 42 of the outer wall 14 of the upper half 22 of the housing 12. The handle 15 is gripped by the user 38. The handle 15 is one of a pair of the handles 86. Each of the pair of handles 86 is positioned within an associated one of the pair of handle wells 17.

An actuator 88 is coupled to the handle 15. The actuator 88 is electrically coupled to the motor 50. The actuator 88 is one of a pair of the actuators 90. An up one 92 of the pair of actuators 90 actuates the motor 50 in a first direction. The pump 54 urges the piston 80 into an extended position so the pair of scissor lifts 72 is urged into the lifting position.

A down one 94 of the pair of actuators 90 actuates the motor 50 in a second direction. The pump 54 urges the piston 80 into a retracted position so the pair of scissor lifts 72 are urged into the lowering position. The pair of actuators 90 is one of a pair of sets 96 of the pair of actuators 90. Each of the pair of sets 96 of the pair of actuators 90 is coupled to an associated one of the pair of the handles 86.

The back side 68 of the outer wall 14 of the lower half 24 of the housing 12 has an access aperture 98 extending therethrough to access the interior of the lower half 24 of the housing 12. An access door 11 is hingedly coupled to the back side 68 of the lower half 24 of the housing 12. The access door 11 closes the access aperture 98. A bar 13 is coupled to the back side 68 of the outer wall 14 of the upper half 22 of the housing 12. The bar 13 is positioned proximate the top wall 16 of the upper half 22 of the housing 12.

A remote input 33 is coupled to the front side 42 of the outer wall 14 of the upper half 22 of the housing 12. The remote input 33 is positioned above the storage door 46. The remote input 33 is electrically coupled to the motor 50. A remote control 29 is provided. The remote control 29 includes a remote cord 35. The remote cord 35 is electrically coupled to the remote input 33, placing the remote control 29 in electromagnetic communication with the motor 50.

A pair of remote actuators 31 is coupled to the remote control 29. The pair of remote actuators 31 actuates the motor 50 in the first and second directions. Moreover, the remote actuators 31 override the up actuator 92 and the down actuator 94. The remote control 29 may be carried by a care giver, allowing the care giver to manipulate the user 38. Additionally, the remote control 29 allows the user 38 to adjust a height of the pad 36 while the user 38 is sitting on the pad 36. The remote control may be stored within the storage well 44.

A plurality of light emitter 37 is coupled to the outer wall 14 of the lower half 24 of the housing 12. Each of the light emitters 37 is electrically coupled to the actuator 88. Additionally, each of the light emitters 37 is positioned adjacent to an associated one of the four corners 28 of the lower half of the housing 12. The light emitters 37 emit light when the actuator 88 is actuated, allowing the user 38 to see in a darkened environment.

A power supply 19 is coupled to the upper surface 52 of the lower half 24 of the housing 12. The power supply 19 is electrically coupled to the actuator 88. The power supply 19 may comprise at least one battery 21.

A charge port 23 is coupled to the housing 12. The charge port 23 is electrically coupled to the power supply 19. A power cord 33 may be electrically coupled to the charge port. Additionally, the power cord 33 may be electrically coupled to a power source 25. The power source 25 may be an electrical outlet of any conventional design. The charge port 23 charges the battery 21.

In use, the user 38 utilizes the assembly 10 if the user 38 falls down. The user 38 grabs the bar 13 to pull themselves up onto the pad 36. The user 38 lies on the pad 36. The user 38 actuates a selected one of the up actuators 92. The upper half 22 of the housing 12 lifts the user 38 so the user 38 may stand up. The assembly 10 allows the user 38 to position themselves in a standing position without the need of assistance. Additionally, the user 38 may utilize the assembly 10 as a walker to assist the user with walking. The user may further utilize the assembly 10 as a footstool.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal lifting assembly configured to lift a user upwardly from a support surface after the user falls such that user does not need assistance, said assembly comprising:

a housing configured to be positioned on the support surface, said housing being divided into an upper half and a lower half of said housing;

a motor coupled to said lower half of said housing;

a pump coupled to said lower half of said housing, said pump being coupled to said motor;

a scissor lift coupled between said top and bottom halves of said housing;

a piston coupled between said bottom half of said housing and said scissor lift, said piston being operationally coupled to said pump, said piston urging said scissor lift in a lifting position having said top half of said housing being spaced upwardly from said bottom half of said housing wherein said scissor lift is configured to lift a user lying on said upper half of said housing, said piston urging said scissor lift in a lowering position having said top half of said housing abutting said bottom half of said housing;

a handle coupled to said top half of said housing wherein said handle is configured to be gripped by the user; and an actuator coupled to said handle, said actuator being operationally coupled to said motor such that said actuator actuates and de-actuates said motor.

2. The assembly according to claim 1, further comprising said housing having an outer wall extending between a top wall and a bottom wall of said housing, said outer wall of said housing having a cut extending around an entire perimeter of said outer wall of said housing such said upper and lower halves of said housing are defined.

3. The assembly according to claim 2, further comprising said housing being positionable on the support surface such that said bottom wall of said lower half of said housing abuts the support surface.

4. The assembly according to claim 2, further comprising a curtain coupled between each of said upper and lower halves of said housing, said curtain being coextensive with said cut such that said curtain conceals an interior of said housing.

5. The assembly according to claim 2, further comprising:

a plurality of roller tracks;

a first pair of said plurality of roller tracks each being coupled to an associated one of an upper surface of said bottom wall of said lower half of said housing and a lower surface of said top wall of said upper half of said housing such that said first pair of roller tracks extends between a first lateral side and a second lateral side of said outer wall of said housing;

a second pair of said plurality of roller tracks being coupled to an associated one of said upper surface of said bottom wall of said lower half of said housing and said lower surface of said top wall of said upper half of said housing such that said second pair of roller tracks extends between said first and second lateral sides of said outer wall of said housing; and each of said first and second pairs of roller tracks being positioned proximate an associated one of a front side and a back side of said outer wall of said housing.

6. The assembly according to claim 5, further comprising:

said scissor lift being one of a pair of said scissor lifts;

a first one of said pair of scissor lifts being slidably coupled between each of said first pair of roller tracks; and a second one of said pair of scissor lifts being slidably coupled between each of said second pair of roller tracks.

7. The assembly according to claim 2, further comprising said handle having a bend thereon such that said handle has an L-shape, said handle being rotatably coupled to a front side of said outer wall of said upper half of said housing.

8. The assembly according to claim 7, further comprising said handle being one of a pair of said handles, each of said pair of handles being positioned proximate an associated one of a first lateral side and a second lateral side of said outer wall of said upper half of said housing.

9. The assembly according to claim 1, further comprising a piston bar coupled to and extending between each of a pair of said scissor lifts, said piston bar being centrally positioned on each of said pair of scissor lifts.

10. The assembly according to claim 9, further comprising:

a bottom end of said piston being coupled to an upper surface of a bottom wall of said lower half of said housing;

a top end of said piston being coupled to said piston bar; and said piston being fluidly coupled to said pump.

11. The assembly according to claim 1, further comprising:

said actuator being electrically coupled to said motor;

said actuator being one of a pair of said actuators;

an up one of said pair of actuators actuating said motor in a first direction such that said pump urges said piston into an extended position;

a down one of said pair of actuators actuating said motor in a second direction such that said pump urges said piston into a retracted position;

said pair of actuators being one of a pair of sets of said pair of actautors; and each of said pair of sets of said pair of actuators being coupled to an associated one of a pair of said handles.

12. The assembly according to claim 1, further comprising:

a power supply coupled to said lower half of said housing;

said power supply being electrically coupled to said actuator; and said power supply comprising at least one battery.

13. A personal lifting assembly configured to lift a user upwardly from a support surface after the user falls such that user does not need assistance, said assembly comprising:

a housing having an outer wall extending between a top wall and a bottom wall of said housing, said outer wall of said housing having a cut extending around an entire perimeter of said outer wall of said housing such an upper and a lower half of said housing are defined, said housing being configured to be positioned on the support surface such that said bottom wall of said lower half of said housing abuts the support surface;

a curtain coupled between each of said upper and lower halves of said housing, said curtain being coextensive with said cut such that said curtain conceals an interior of said housing;

a motor coupled to an upper surface of said bottom wall of said lower half of said housing;

a pump coupled to said upper surface of said bottom wall of said lower half of said housing, said pump being coupled to said motor;

a plurality of roller tracks;

a first pair of said plurality of roller tracks each being coupled to an associated one of an upper surface of said bottom wall of said lower half of said housing and a lower surface of said top wall of said upper half of said housing such that said first pair of roller tracks extends between a first lateral side and a second lateral side of said outer wall of said housing;

a second pair of said plurality of roller tracks being coupled to an associated one of said upper surface of said bottom wall of said lower half of said housing and said lower surface of said top wall of said upper half of said housing such that said second pair of roller tracks extends between said first and second lateral sides of said outer wall of said housing;

each of said first and second pairs of roller tracks being positioned proximate an associated one of a front side and a back side of said outer wall of said housing;

a scissor lift, said scissor lift being one of a pair of said scissor lifts;

a first one of said pair of scissor lifts being slidably coupled between each of said first pair of roller tracks;

a second one of said pair of scissor lifts being slidably coupled between each of said second pair of roller tracks;

a piston bar coupled to and extending between each of said pair of scissor lifts, said piston bar being centrally positioned on each of said pair of scissor lifts;

a piston, a bottom end of said piston being coupled to said upper surface of said bottom wall of said lower half of said housing, a top end of said piston being coupled to said piston bar, said piston being fluidly coupled to said pump;

said piston urging said pair of scissor lifts in a lifting position having said top half of said housing being spaced upwardly from said bottom half of said housing wherein said pair of scissor lifts is configured to lift a user lying on said upper half of said housing, said piston urging said pair of scissor lifts in a lowering position having said top half of said housing abutting said bottom half of said housing;

a handle having a bend thereon such that said handle has an L-shape, said handle being rotatably coupled to said front side of said outer wall of said upper half of said housing wherein said handle is configured to be gripped by the user;

said handle being one of a pair of said handles, each of said pair of handles being positioned proximate an associated one of said first and second lateral sides of said outer wall of said upper half of said housing;

an actuator coupled to said handle, said actuator being electrically coupled to said motor;

said actuator being one of a pair of said actuators;

an up one of said pair of actuators actuating said motor in a first direction such that said pump urges said piston into an extended position;

a down one of said pair of actuators actuating said motor in a second direction such that said pump urges said piston into a retracted position;

said pair of actuators being one of a pair of sets of said pair of actuators;

each of said pair of sets of said pair of actuators being coupled to an associated one of said pair of said handles; and a power supply coupled to said lower half of said housing, said power supply being electrically coupled to said actuator, said power supply comprising at least one battery.

* * * * *